US008735754B2

(12) United States Patent
Yoshida et al.

(10) Patent No.: US 8,735,754 B2
(45) Date of Patent: May 27, 2014

(54) POWER TRANSFER SWITCH

(75) Inventors: Katsuhiro Yoshida, Kamo-Gun (JP); Kazutoshi Ito, Seto (JP)

(73) Assignee: Aichi Electric Works Co., Ltd., Kasugai-Shi (JP)

( * ) Notice: Subject to any disclaimer, the term of this patent is extended or adjusted under 35 U.S.C. 154(b) by 143 days.

(21) Appl. No.: 13/378,521

(22) PCT Filed: Apr. 7, 2010

(86) PCT No.: PCT/JP2010/002527

§ 371 (c)(1),
(2), (4) Date: Dec. 15, 2011

(87) PCT Pub. No.: WO2011/125120

PCT Pub. Date: Oct. 13, 2011

(65) Prior Publication Data

US 2012/0090972 A1 Apr. 19, 2012

(51) Int. Cl.
*H01H 23/00* (2006.01)

(52) U.S. Cl.
USPC ..... 200/401; 200/1 R

(58) Field of Classification Search
USPC ..... 200/401, 1 R, 33 P, 34, 416, 428, 459, 200/461, 50, 32, 33, 573, 574
See application file for complete search history.

(56) References Cited

U.S. PATENT DOCUMENTS

| | | | | |
|---|---|---|---|---|
| 3,185,790 | A * | 5/1965 | Salerno | 335/69 |
| 6,015,959 | A * | 1/2000 | Slepian et al. | 200/400 |
| 6,538,223 | B1 | 3/2003 | Yoshida et al. | |
| 6,861,930 | B2 * | 3/2005 | Simms et al. | 335/14 |
| 6,940,032 | B2 * | 9/2005 | Sirajtheen et al. | 200/400 |
| 8,354,604 | B2 * | 1/2013 | Park et al. | 200/293 |
| 2004/0016627 | A1 * | 1/2004 | Rademacher et al. | 200/1 R |
| 2010/0288610 | A1 * | 11/2010 | Krieger et al. | 200/327 |

FOREIGN PATENT DOCUMENTS

| | | | |
|---|---|---|---|
| JP | 56-022725 | U | 2/1981 |
| JP | 07-030423 | U | 6/1995 |
| JP | 2003-123597 | A1 | 4/2003 |
| JP | 3151075 | U | 5/2009 |
| JP | 2009-272077 | A1 | 11/2009 |

* cited by examiner

*Primary Examiner* — Briggitte R Hammond
(74) *Attorney, Agent, or Firm* — Burr & Brown, PLLC

(57) ABSTRACT

A power transfer switch in which a cross bar including a movable contact is rotated to come into contact with one of fixed contacts disposed on left and right sides of the cross bar. The cross bar has a non-circular cross-section including a protruded piece on left and right, and a rotating angle thereof is greater than a rotating allowable angle of the movable contact between the fixed contacts. A through hole into which the cross bar is inserted with play is formed on a base portion of the movable contact, and a step portion for receiving the protruded piece of the cross bar and a spring housing portion extended in a direction of a central axis of the movable contact are formed in the through hole. A compression spring is accommodated in the spring housing portion to cause the cross bar to elastically hold the movable contact.

3 Claims, 6 Drawing Sheets

POWER TRANSFER SWITCH

BACKGROUND OF THE INVENTION

1. Field of the Invention

The present invention relates to a power transfer switch which changes over a power source from a commercial power to another power such as an emergency power when a power failure occurs in the commercial power that is connected to a load, and is used for automatically changing over the power source into the commercial power in a power return of the commercial power.

2. Description of Related Art

A power transfer switch is an apparatus for changing over a plurality of power sources to supply an electricity to a load, and is widely used in home or facilities provided with an emergency power (a preliminary power source) such as a power generator for taking a countermeasure against the power failure. In the change-over of the power source, a cross bar is rotated to cause a movable contact held on the cross bar to come into contact with a fixed contact on the opposite side, thereby changing over the power source.

It is desirable to change over the power source in a time as short as possible. In addition, it is necessary to reliably cause the movable contact to come into contact with the fixed contact after the change-over. As described in Patent Document 1, therefore, there is employed a structure in which a cross bar is rotated instantaneously by utilizing a toggle mechanism in the change-over of the power source, and furthermore, a spring is provided between the crossbar and the movable contact to maintain a contact pressure between the movable contact and the fixed contact by a spring force.

FIGS. 1 and 2 are views for explaining an operation of the conventional movable contact described in the Patent Document 1. A movable contact 51 is a metal plate obtained by bending a base portion 52, and the base portion 52 is flexibly supported on a cross bar 53 to be rotated by means of a toggle mechanism which is not shown. Moreover, a protruded piece 54 having an L-shaped cross-section is erected on the cross bar 53 with a clearance between the protruded piece 54 and the movable contact 51. Furthermore, a compression spring 55 is provided on the opposite side to the protruded piece 54 of the cross bar 53, and a lower part of the movable contact 51 is elastically pressed against a side wall of the protruded piece 54.

When the cross bar 53 is rotated in a direction of the protruded piece 54 (a leftward direction in the drawing) as shown in FIG. 1, a contact point on a tip of the movable contact 51 first comes into contact with a contact point of a fixed contact 56 on a left side. However, the cross bar 53 is further rotated excessively by a certain angle. Therefore, the movable contact 51 is pressed by a lower part of the side wall of the protruded piece 54. At this time, the compression spring 55 provided between the movable contact 51 and the cross bar 53 presses the lower part of the movable contact 51 toward the side wall of the protruded piece 54. Therefore, a rotation moment in a counterclockwise direction with a contact point A of the lower part of the side wall set to be a fulcrum is generated in the movable contact 51. For this reason, the contact point on the tip of the movable contact 51 is pressed in the direction of the fixed contact 56 to maintain a contact pressure between the contact points.

When the cross bar 53 is rotated in the opposite direction to the protruded piece 54 (a rightward direction in the drawing) as shown in FIG. 2, moreover, the contact point on the tip of the movable contact 51 first comes into contact with a contact point of a fixed contact 57 on a right side. However, the cross bar 53 is further rotated excessively by a certain angle. Therefore, the movable contact 51 is pressed by an upper part of the side wall of the protruded piece 54. At this time, the compression spring 55 provided between the movable contact 51 and the cross bar 53 presses the lower part of the movable contact 51 toward the side wall of the protruded piece 54. Consequently, a rotation moment in a clockwise direction setting a contact point P with an upper part of the side wall as a fulcrum is generated in the movable contact 51. For this reason, the contact point on the tip of the movable contact 51 is pressed in the direction of the fixed contact 57 to maintain a contact pressure between the contact points.

As described above, the power transfer switch described in the Patent Document 1 has the structure in which the contact pressure between the fixed contacts 56 and 57 on both of left and right sides and the movable contact 51 is generated by means of the single compression spring 55. In the state of FIG. 1, however, the fulcrum A serves as the lowest end of the movable contact 51, a power point B serves as the pressing point of the compression spring 55, and an action point C serves as the contact point on the tip of the movable contact 51. Therefore, a lever ratio of AB/AC is obtained. On the other hand, in the state of FIG. 2, the fulcrum P is positioned between the power point B and the action point C. Therefore, a lever ratio of PB/PC is obtained. Thus, the lever ratios are not equal to each other in the states of FIGS. 1 and 2. For this reason, there is a problem in that the contact pressures to be applied to the contact points by the compression spring 55 are not equal to each other.

PRIOR ART DOCUMENT

Patent Document

Patent Document 1: Japanese Laid-Open Patent Publication No. 2003-123597

SUMMARY OF THE INVENTION

Accordingly, it is an object of the present invention to solve the conventional problems described above and to provide a power transfer switch which can generate an equal contact pressure for any of left and right fixed contacts by means of a single compression spring.

The present invention made to solve the above-described problems provides a power transfer switch in which a cross bar comprising a movable contact is rotated and the movable contact is caused to come into contact with one of fixed contacts disposed on both of left and right sides of the cross bar, wherein the cross bar has a non-circular cross-section comprising a protruded piece on left and right, and a rotating angle thereof is greater than a rotating allowable angle of the movable contact between the left and right fixed contacts, a through hole into which the cross bar is inserted with a play is formed on a base portion of the movable contact, and a step portion for receiving the protruded piece of the cross bar and a spring housing portion extended in a direction of a central axis of the movable contact are formed in the through hole, and a compression spring is accommodated in the spring housing portion to cause the cross bar to elastically hold the movable contact.

The power transfer switch according to the present invention has the structure in which the cross bar and the movable contact are elastically held by means of the compression spring. The rotating angle of the cross bar is set to be greater than the rotating allowable angle of the movable contact between the left and right fixed contacts so that one of the protruded pieces of the cross bar is rotated excessively while pressing only one of the step portions of the movable contact also after the movable contact comes into contact with the fixed contact. At this time, the compression spring disposed on the central axis of the movable contact presses the movable contact in order to return the other protruded piece floating from the step portion into an original position. Consequently, a contact point on a tip of the movable contact presses the fixed contact by setting, as a fulcrum, a point in which the protruded piece presses the step portion. With the structure, a ratio of a distance between the point in which the protruded piece presses the step portion and a point in which the compression spring presses the movable contact to a distance between the point in which the protruded piece presses the step portion and a point in which the contact point on the tip of the movable contact presses the fixed contact can be set to be equal on both of left and right sides. Accordingly, an equal contact pressure can be generated for any of the left and right fixed contacts by means of the single compression spring.

DETAILED DESCRIPTION OF THE INVENTION

An embodiment according to the present invention will be described below in detail.

Figure 1:
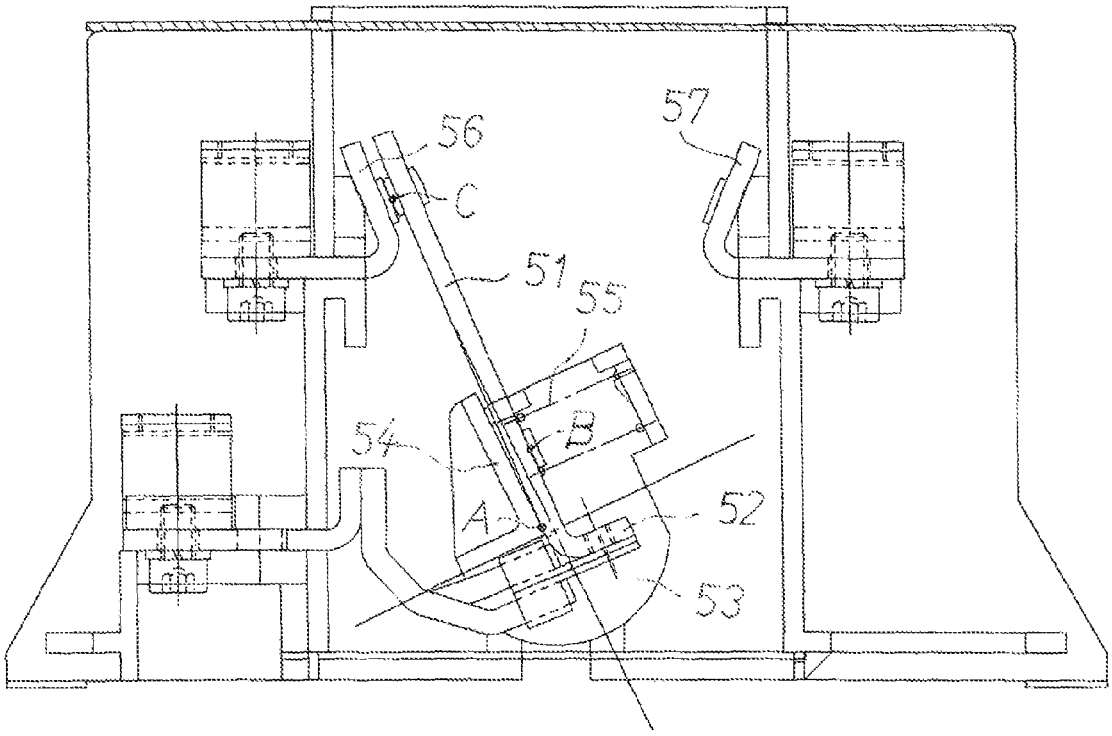
FIG. 1 is a view for explaining the prior art.
Figure 2:
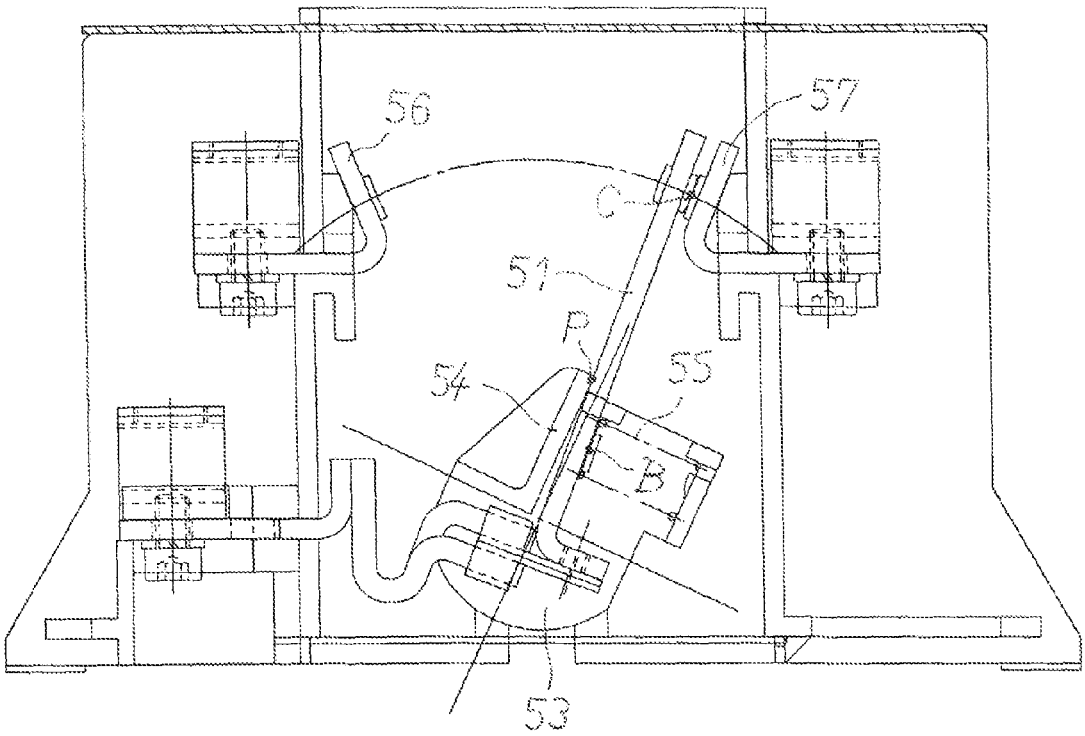
FIG. 2 is a view for explaining the prior art.
Figure 3:
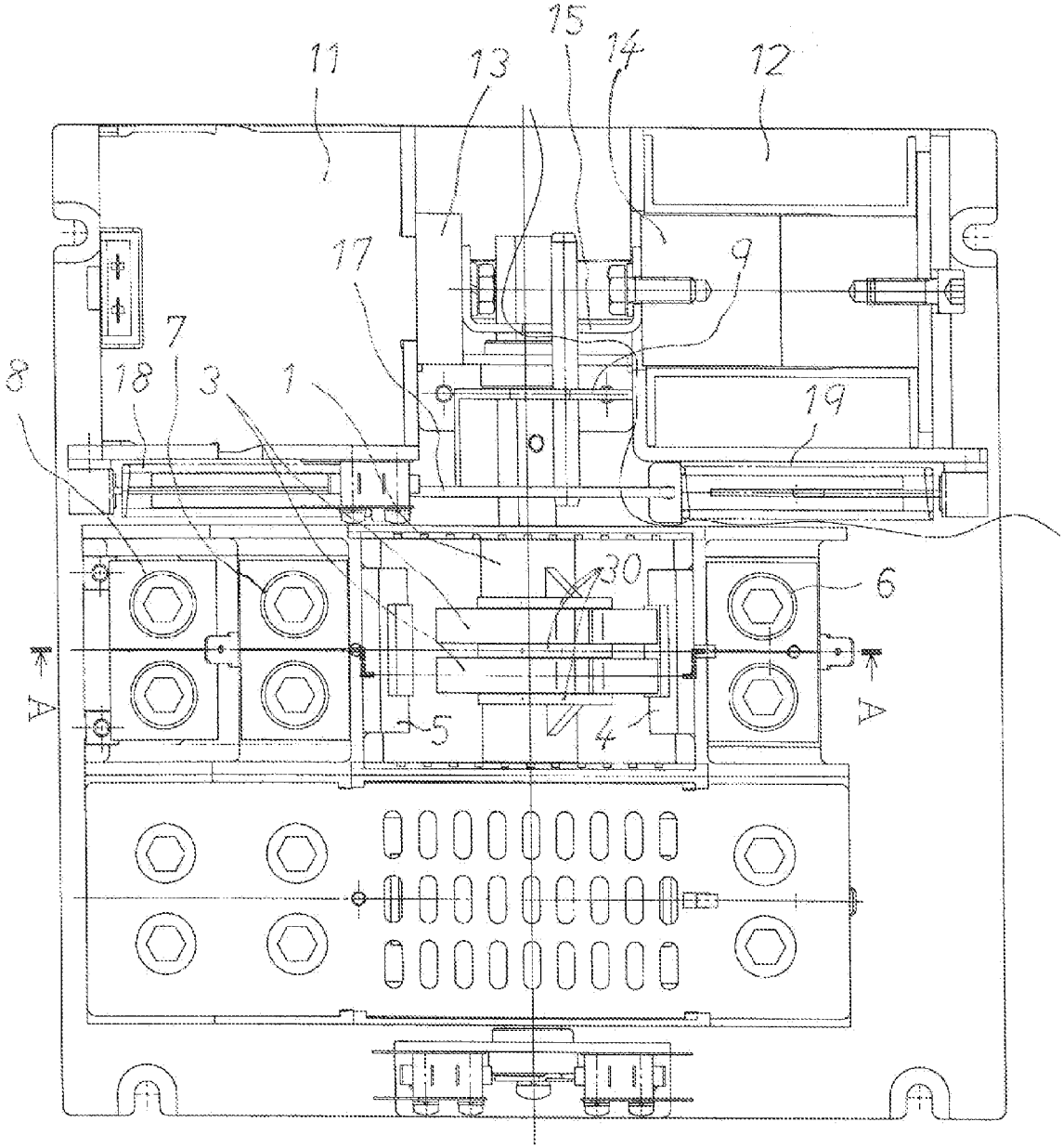
FIG. 3 is a general plan view showing an embodiment according to the present invention.
Figure 4:
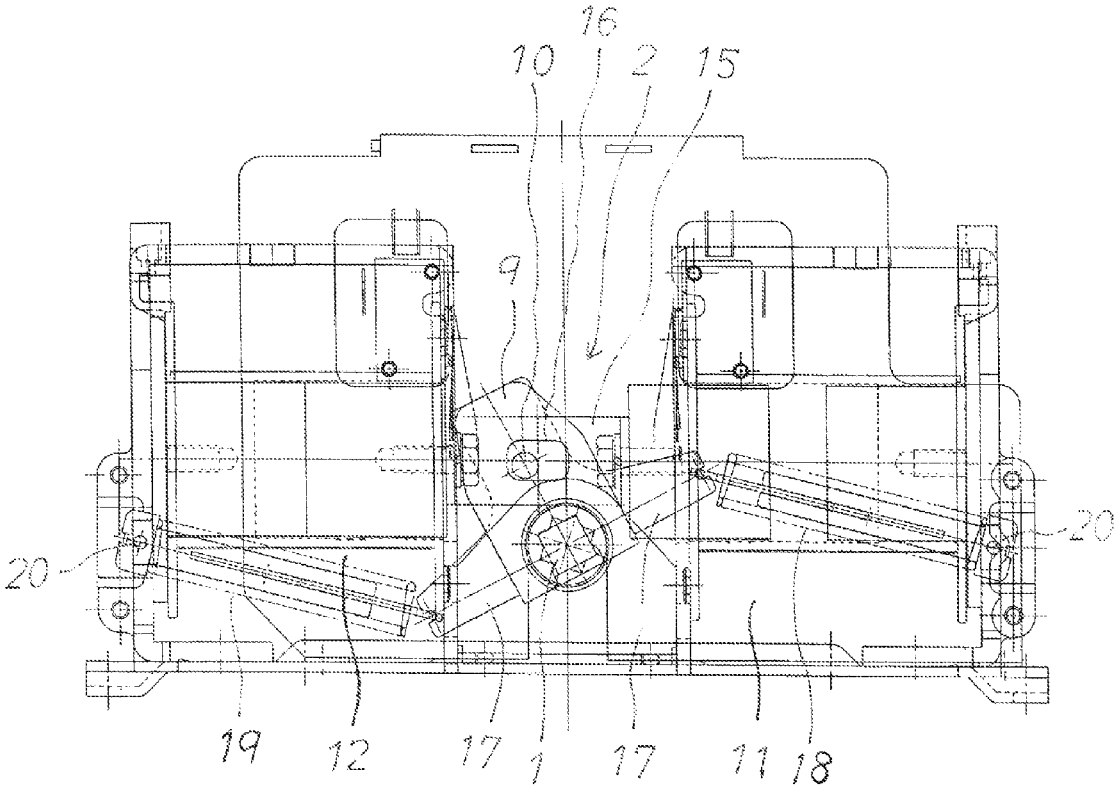
FIG. 4 is a top view of FIG. 3.

In FIGS. 3 and 4, 1 denotes a cross bar having a non-circular cross-section and supported on a body rotatably in a left and right direction, 2 denotes a toggle mechanism for rotating the cross bar 1 in any of leftward and rightward directions, 3 denotes a movable contact supported on the cross bar 1, 4 denotes a fixed contact on a right side, and 5 denotes a fixed contact on a left side. The fixed contact 4 on the right side is connected to a power terminal 6 on the right side and the fixed contact 5 on the left side is connected to a power terminal 7 on the left side. Moreover, the movable contact 3 is connected to a load terminal 8.

For example, the power terminal 6 on the right side is connected to a commercial power source and the power terminal 7 on the left side is connected to an emergency power source. The movable contact 3 is always caused to come into contact with the fixed contact 4 on the right side to supply a power from the commercial power source to the load terminal 8. In the case in which the commercial power source causes a power failure, however, a sensor detects the power failure to rotate the cross bar 1 leftward, and the movable contact 3 is caused to come into contact with the fixed contact 5 on the left side so that a power can be supplied from the emergency power source to the load terminal 8.

A drive handle 9 is fixed to the cross bar 1 upward in the drawing, and a rod 10 is provided on a side surface of the drive handle 9. Moreover, a pair of solenoids 11 and 12 are provided opposite to each other on both of left and right sides, and tips of plungers 13 and 19 of the respective solenoids are coupled to each other through a coupling member 15. A slot. 16 is formed on the coupling member 15 and the rod 10 of the drive handle 9 is inserted therethrough. For this reason, when any of the solenoids 11 and 12 is turned ON, the coupling member 15 is pulled leftward or rightward and the drive handle 9 is correspondingly moved leftward or rightward to rotate the cross bar 1.

Moreover, a link arm 17 extended toward both the left and right sides is fixed to the cross bar 1, and compression springs 18 and 19 are provided on both ends thereof to spring back the link arm 17 from both sides. The cross bar 1 to be a rotating shaft of the link arm 17 and attaching pins 20 and 20 to bodies of the compression coil springs 18 and 19 are provided in alignment with each other. For this reason, the link arm 17 is unstable over a straight line and tries to take an inclined stable position leftward or rightward as shown in FIG. 4. Accordingly, the drive handle 9 is moved beyond a neutral point by means of the solenoids 11 and 12, and at the same time, the link arm 17 is rapidly moved to an inclination position by an elastic force of the compression coil springs 18 and 19. As a result, the cross bar 1 is instantaneously rotated to cause the movable contact 3 to come into contact with the fixed contact on the opposite side.

Figure 5:
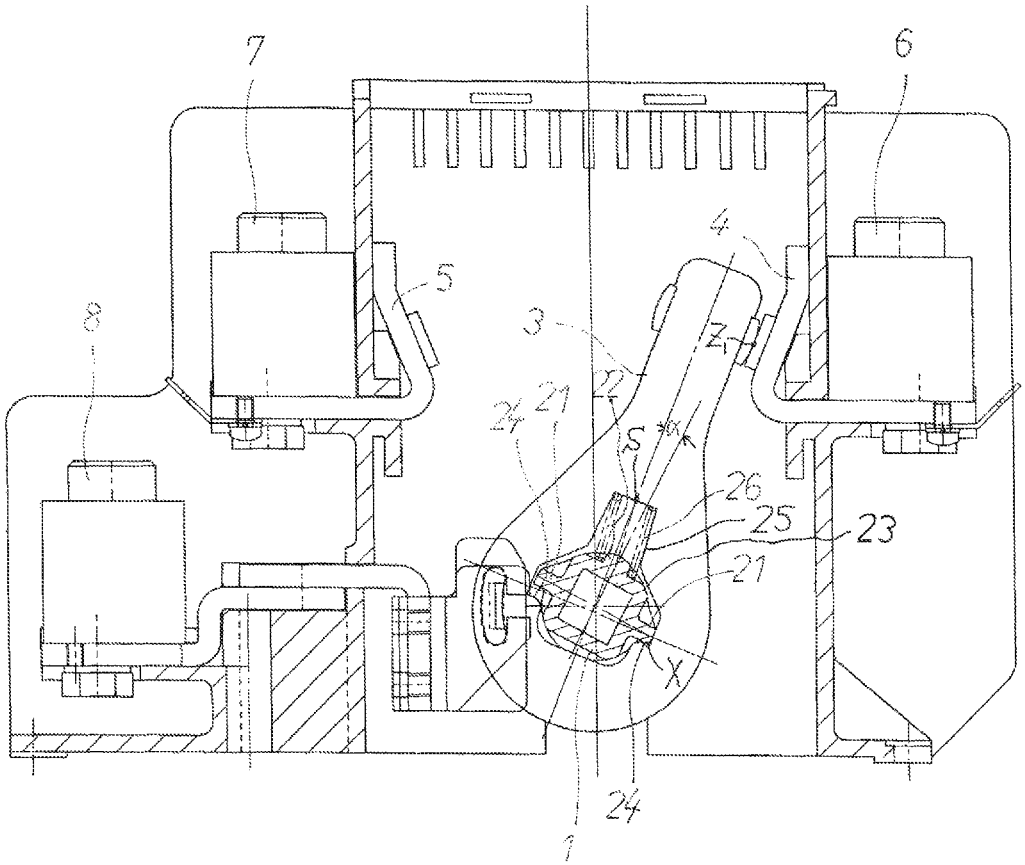
FIG. 5 is an A-A cross-sectional view of FIG. 3.
Figure 6:
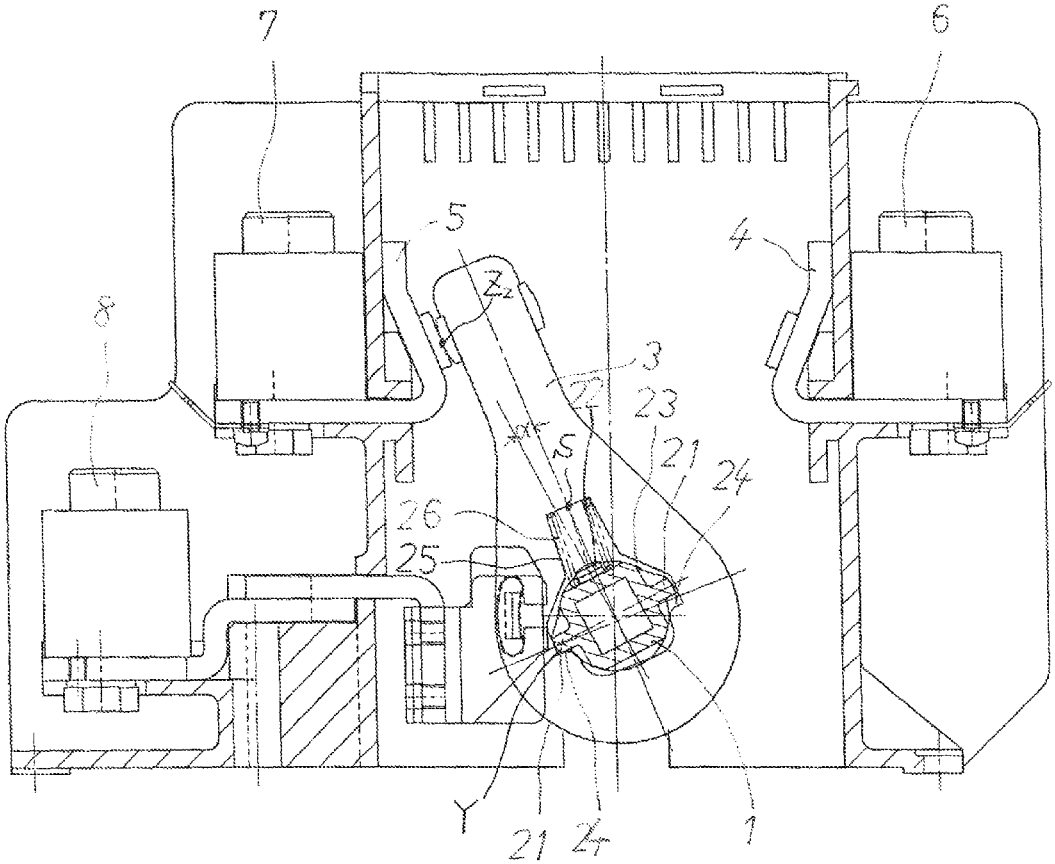
FIG. 6 is a view for explaining an operation according to the embodiment of the present invention.

A rotation angle of the cross bar 1 is regulated depending on an angle at which the drive handle 9 comes into contact with the body. The rotating angle of the cross bar 1 is set to be greater than a rotating allowable angle of the movable contact 3 between the left and right fixed contacts 4 and 5. A rotating structure of the cross bar 1 utilizing the toggle mechanism is the same as in the prior art as described in the Patent Document 1. With reference to FIGS. 5 to 6, description will be given to a structure for attaching the movable contact 3 to the cross bar 1 which is a feature of the present invention.

As shown in FIG. 5, a portion of the cross bar 1 which attaches the movable contact 3 thereto has a non-circular cross-section comprising a protruded piece 21 on left and right. In the present embodiment, the cross bar 1 takes an almost square shape and four corner portions are chamfered to take a shape of a circular arc around a rotating central axis of the cross bar 1. Moreover, a spring receiving seat 22 is formed on an upper surface.

A through hole 23 through which the cross bar 1 is to be inserted with a play is formed on a base portion of the movable contact 3, and a step portion 24 for receiving the left and right protruded pieces 21 is formed on left and right in the through hole 23. Moreover, a spring housing portion 25 extended in a direction of the central axis of the movable contact 3 is formed. A compression spring 26 is accommodated in the spring housing portion 25. The compression spring 26 is a compression coil spring, and has a lower end fitted in the spring receiving seat 22 of the cross bar 1 and an upper end provided in close contact with a ceiling surface of the spring housing portion 25. For this reason, the movable contact 3 is elastically held on the cross bar 1 in a state in which it is always pushed upward.

In the present invention, thus, the movable contact. 3 is elastically held on the cross bar 1 and is not fixed. In the present embodiment, therefore, a guide 30 is provided on a center and both sides of two movable contacts 3 to support the movable contacts 3 so as not to become unsteady in the axial direction of the cross bar 1 as shown in FIG. 3. However, the number of the movable contacts 3 is optional and is not restricted to the present embodiment.

Next, the function of the present invention will be described. FIG. 5 shows a state in which the cross bar 1 is rotated rightward. The movable contact 3 is rotated rightward together with the cross bar 1. Since the rotating angle of the cross bar 1 is set to be greater than the rotating allowable angle of the movable contact 3 between the left and right fixed contacts 4 and 5 (e.g. see the $\alpha$ angle depicted in FIGS. 5 and 6), however, the cross bar 1 is further rotated in a rightward direction also after the contact point on the tip of the movable contact 3 collides with the fixed contact 4 and is thus stopped. For this reason, the protruded piece 21 on the right side of the cross bar 1 abuts against the step portion 24 on the right side of the movable contact 3 as shown in the drawing of FIG. 5 so that the protruded piece 21 on the left side is brought into a floating state from the step portion 24 on the left side.

At this time, the compression spring 26 accommodated in the spring housing portion 25 presses the movable contact 3 in such a direction as to return the protruded piece 21 on the left side of the floating cross bar 1 to a position Y in which it comes into contact with the step portion 24 on the left side of the movable contact 3 by setting, as a fulcrum, a point X in which the protruded piece 21 on the right side of the cross bar 1 abuts against the step portion 24 on the right side of the movable contact 3. As a result, a contact point $Z_1$ on the tip of the movable contact 3 presses the fixed contact 4 by setting, as a fulcrum, the point X in which the protruded piece 21 on the right side of the cross bar 1 abuts against the step portion 24 on the right side of the movable contact 3, thereby generating a contact pressure.

When the cross bar 1 is rotated in the leftward direction by means of the toggle mechanism 2 in order to change over a power source, next, the movable contact 3 is also rotated leftward so that the cross bar 1 is further rotated in the leftward direction also after the contact point on the tip of the movable contact 3 collides with the fixed contact 5 on the left side and is thus stopped. For this reason, the protruded piece 21 on the left side of the cross bar 1 abuts against the step portion 24 on the left side of the movable contact 3 as shown in FIG. 6 so that the protruded piece 21 on the right side is brought into a floating state from the step portion 24 on the right side. At this time, the compression spring 26 accommodated in the spring housing portion 25 presses the movable contact 3 in such a direction as to return the protruded piece 21 on the right side of the floating cross bar 1 to the position X in which it comes into contact with the step portion 24 on the right side of the movable contact 3 by setting, as a fulcrum, a point Y in which the protruded piece 21 on the left side of the cross bar 1 abuts against the step portion 24 on the left side of the movable contact 3. As a result, a contact point $Z_2$ on the tip of the movable contact 3 presses, the fixed contact 4 by setting, as a fulcrum, the point Y in which the protruded piece 21 on the left side of the cross bar 1 abuts against the step portion 24 on the left side of the movable contact 3, thereby generating a contact pressure.

In the present invention, there is employed the structure in which a ratio ($XS/XZ_1$) of the distance between the point X in which the protruded piece 21 on the right side of the cross bar 1 abuts against the step portion 24 on the right side of the movable contact 3 and a point S in which the movable contact 3 presses the compression spring 26 to the distance between the point X in which the protruded piece 21 on the right side of the cross bar 1 abuts against the step portion 24 on the right side of the movable contact 3 and the point $Z_1$ in which the contact point on the tip of the movable contact 3 presses the fixed contact 4 is equal to a ratio ($YS/YZ_2$) of the distance between the point Y in which the protruded piece 21 on the left side of the cross bar 1 abuts against the step portion 24 on the left side of the movable contact 3 and the point S in which the compression spring 26 presses the movable contact 3 to the distance between the point Y in which the protruded piece 21 on the left side of the cross bar 1 abuts against the step portion 24 on the left side of the movable contact 3 and the point $Z_2$ in which the contact point on the tip of the movable contact 3 presses the fixed contact 5. Therefore, the contact pressure generated in the contact of the movable contact 3 with the fixed contact 4 is equal to the contact pressure generated in the contact of the movable contact 3 with the fixed contact 5. Therefore, it is possible to eliminate an inequality of a contact pressure as in the prior art with the use of the single compression spring 26.

EXPLANATION OF DESIGNATION

1 cross bar
2 toggle mechanism
3 movable contact
4 fixed contact on right side
5 fixed contact on left side
6 power terminal
7 power terminal
8 load terminal
9 drive handle
10 rod
11 solenoid
12 solenoid
13 plunger
14 plunger
15 coupling member
16 slot
17 link arm
18 compression coil spring
19 compression coil spring
20 attaching pin
21 protruded piece
22 spring receiving seat
23 through hole
24 step portion
25 spring housing portion
26 compression spring
30 guide
51 movable contact
52 base portion
53 cross bar
54 protruded piece
55 compression spring
56 fixed contact
57 fixed contact

The invention claimed is:

1. A power transfer switch in which a cross bar comprising a movable contact is rotated and the movable contact is caused to come into contact with one of fixed contacts disposed on both of left and right sides of the cross bar, wherein the cross bar has a non-circular cross-section comprising a protruded piece on left and right, and a rotating angle thereof is greater than a rotating allowable angle of the movable contact between the left and right fixed contacts, a through hole into which the cross bar is inserted with a play is formed on a base portion of the movable contact, and a step portion for receiving the protruded piece of the cross bar and a spring housing portion extended in a direction of a central axis of the movable contact are formed in the through hole, and a compression spring is accommodated in the spring housing portion to cause the cross bar to elastically hold the movable contact.

2. The power transfer switch according to claim 1, wherein the movable contact comes into contact with the fixed contact and the cross bar is further rotated to float the protruded piece on one side of the cross bar from the step portion of the movable contact, and a contact pressure between the movable contact and the fixed contact is generated by utilizing a force for pressing the movable contact in such a direction as to return the protruded piece which is floated into a position in which the protruded piece comes into contact with the step portion of the movable contact by means of a compression spring.

3. The power transfer switch according to claim 1, wherein the cross bar is rotated by means of a toggle mechanism.

* * * * *